United States Patent [19]

Rickle

[11] Patent Number: 4,622,169

[45] Date of Patent: Nov. 11, 1986

[54] ELECTRICALLY CONDUCTING COMPLEXES

[75] Inventor: Gregory K. Rickle, Midland, Mich.

[73] Assignee: The Dow Chemical Company, Midland, Mich.

[21] Appl. No.: 667,301

[22] Filed: Nov. 1, 1984

[51] Int. Cl.[4] ..... H01B 1/00; H01B 1/06

[52] U.S. Cl. ..... 252/500; 252/518; 252/519

[58] Field of Search ..... 252/500, 518, 519

[56] References Cited

U.S. PATENT DOCUMENTS 4,500,459 2/1985 Hotta et al. ..... 252/500 X 4,519,938 5/1985 Papir ..... 252/500

4,522,745 6/1985 Kurkov ..... 252/500

*Primary Examiner*—Lucille M. Phynes

[57] ABSTRACT

The invention is an electrically conducting complex comprising the reaction product of (a) an anthraquinone or naphthaquinone which is substituted with at least one primary amino group and at least one other substituent comprising a second primary amino group, a hydroxy group or a mercapto group; and (b) a salt of a Group VIII metal, Group IB metal or Group IIB metal wherein the complex has a conductivity of between about 0.0001 and 30 s/cm.

48 Claims, No Drawings

ELECTRICALLY CONDUCTING COMPLEXES

BACKGROUND OF THE INVENTION

This invention relates to novel electrical conducting complexes. More particularly, it relates to electrical conducting complexes of a polymeric nature.

These electrical conducting complexes have the properties of semiconducters. These complexes are useful in batteries, as electrochemical catalysts, for example, for the halogenation of hydrocarbons, and as semiconducters.

Conducting organic materials have received considerable attention in the past. Acker et al., *J.A.C.S.*, 82, 6408 (1960); found charged transfer complexes of tetracyanoquinodimethane and electron donors formed crystalline conducting materials. Little, *Phys. Review*, 134, (6a), A1416 (1964), proposed the possibility of room temperature superconductivity with conjugated polymers. McDiarmid oxidized polyacetylene films with arsenic pentafluoride. The oxidized polyacetylene film had a conductivity comparable to mercury on a weight basis. See Shirakowa et al., *J.A.C.S. Chemical Communications*, 578 (1977). Several other conjugated polymers have been found to be highly conducting when oxidized with arsenic pentafluoride or reduced with sodium or potassium naphthalides. Polymers receiving the most attention have been poly(paraphenylene), poly(phenylenesulfide) and poly(pyrrole).

Major problems preventing the commercial application of conducting polymers have been their instability, especially in the presence of oxygen and water, and the lack of fabricability before and/or after attaining high conductivity.

What are needed are electrically conducting complexes which are stable in the presence of oxygen and water and can be fabricated.

SUMMARY OF THE INVENTION

The invention is an electrically conducting complex comprising the reaction product of (a) an anthraquinone or naphthaquinone which is substituted with at least one primary amino group and further substituted with at least one other substituent comprising a second primary amino group, a hydroxy group or a mercapto group; and (b) a salt of a Group VIII metal, Group IB metal or Group IIB metal; wherein the complex has a conductivity of between about 0.0001 and 30 S/cm with the proviso that the primary amino group, and at least one of a second amino, a hydroxy, or a mercapto group are on nonadjacent carbon atoms.

Another aspect of the invention is a process for the preparation of electrically conducting complexes which comprises contacting (a) an anthraquinone or naphthaquinone substituted with at least one amino group and further substituted with a second amino, a hydroxy or a mercapto group, wherein the amino group and the second amino, the hydroxy or the mercapto group are on nonadjacent carbon atoms; with (b) a Group VIII, Group IB or Group IIB salt;

in a polar aprotic reaction medium, in the presence of an oxygen-containing gas under conditions such that an electric conducting complex is prepared.

The complexes of this invention have utility in batteries, as electrochemical catalysts, and as semiconducters. Furthermore, the electrical conducting complexes of this invention have good conductivity, are stable to air and water, and can be easily fabricated to films or as compressed powders.

DETAILED DESCRIPTION OF THE INVENTION

Anthraquinones useful in this invention include those which are substituted with at least one primary amino group, and further substituted with at least one substituent of hydroxy, amino or mercapto wherein the first amino group and one of the groups comprising hydroxy, amino or mercapto are on nonadjacent carbon atoms. The anthraquinones useful in this invention may contain more than one amino group and more than one hydroxy or mercapto group. The anthraquinones may be further substituted with a variety of substituents including halo, aryloxy, alkoxy, aralkoxy, alkaryloxy, alkyl, aryl, aralkyl, alkaryl, nitro and cyano; wherein the alkyl, alkaryl, aryl, aralkyl, alkoxy, aryloxy, alkaryloxy and aralkoxy groups are unsubstituted or substituted with one or more substituents comprising halo, hydroxy, amino, cyano or nitro groups. It has been discovered that such substituents generally result in lower conductivities when present.

Preferred anthraquinones generally correspond to the formula

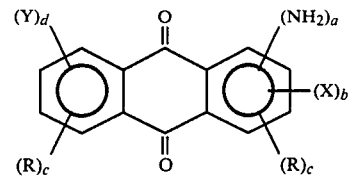

wherein

R is separately in each occurrence halo, aryloxy, alkoxy, aralkoxy, alkaryloxy, alkyl, aryl, aralkyl, alkaryl, nitro or cyano, wherein the alkyl, alkaryl, aryl, aralkyl, alkoxy, aryloxy, alkaryloxy or aralkoxy groups are unsubstituted or substituted with one or more substituents comprising halo, hydroxy, amino, cyano or nitro groups;

X is separately in each occurrence hydroxy or mercapto groups;

Y is separately in each occurrence a primary amino, hydroxy or mercapto group;

a is separately in each occurrence an integer of from 1 to 4, inclusive;

b is separately in each occurrence an integer of from 0 to 3, inclusive;

c is separately in each occurrence an integer of from 0 to 3, inclusive; and d is separately in each occurrence an integer of from 0 to 4, inclusive;

with the proviso that the sum of a, b and d must be 2 or greater; and with the further proviso that non-adjacent carbon atoms are substituted with two $NH_2$ moieties, or with one $NH_2$ moiety and either an OH or SH moiety. R is preferably halo, $C_{1-20}$ aryloxy, $C_{1-20}$ alkoxy, $C_{1-20}$ aralkoxy or $C_{1-20}$ alkaryloxy, wherein the aryloxy, alkoxy, alkaryloxy or aralkoxy groups are unsubstituted or substituted with a halo or hydroxy group. R is even more preferably halo, phenoxy, (2-hydroxyethyl)-phenoxy or $C_{1-10}$ alkoxy. X is preferably hydroxy. Y is preferably hydroxy or amino; and most preferably amino. Preferably, a is the integer 1 or 2. Preferably, b is the integer 0 or 1; and most preferably 0. Preferably, c is the integer 0 or 1; and most preferably 0. Preferably, d is the integer 0 or 1.

Examples of anthraquinones which are useful in this invention include 2,6-diamino anthraquinone, 1,4-diamino anthraquinone, 1-amino-4-hydroxy anthraquinone, 1,4,5,8-tetra amino anthraquinone, 2-chloro-1,4-diamino anthraquinone, 2,3-dichloro-1,4-diamino anthraquinone, 2-phenoxy-1,4-diamino anthraquinone, 2-(4-methyl phenoxy)-1,4-diamino anthraquinone, 2-(4-hydroxy ethyl phenoxy)-1,4-diamino anthraquinone, 2-(4-dodecyl phenoxy)-1,4-diamino anthraquinone, 1,5-diamino anthraquinone, 1,6-diamino anthraquinone or 1,8-diamino anthraquinone. More preferred anthraquinones useful in this invention include 2,6-diamino anthraquinone, 1,4-diamino anthraquinone, 1-amino-4-hydroxy anthraquinone, 1,4,5,8-tetra amino anthraquinone, 2-chloro-1,4-diamino anthraquinone, 2,3-dichloro-1,4-diamino anthraquinone, 2-phenoxy-1,4-diamino anthraquinone, 2-(4-methyl phenoxy)-1,4-diamino anthraquinone, 2-(4-hydroxy ethyl phenoxy)-1,4-diamino anthraquinone or 2-(4-dodecyl phenoxy)-1,4-diamino anthraquinone. The most preferred anthraquinone useful in this invention is 1,4-diamino anthraquinone.

Naphthaquinones useful in this invention include naphthaquinones which are substituted with at least one amino group, and at least one hydroxy, amino or mercapto group, wherein the amino moiety and the hydroxy, amino or mercapto group are on non-adjacent carbon atoms. The naphthaquinone may be substituted with more than one amino group, hydroxy group, mercapto group or a mixture thereof. The naphthaquinones may be further substituted with a variety of substituents; among such substituents are halo, aryloxy, alkoxy, aralkoxy, alkaryloxy, alkyl, aryl, aralkyl, alkaryl, nitro or cyano, wherein the alkyl, alkaryl, aryl, aralkyl, alkoxy, aryloxy, alkaryloxy or aralkoxy groups are unsubstituted or substituted with one or more substituents comprising halo, hydroxy, amino, cyano or nitro groups. It has been discovered that the presence of substituents results in the reduction of the conductivity of the complexes prepared. Preferred naphthaquinones correspond to the formula

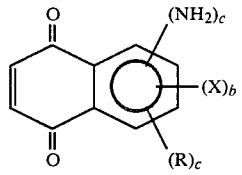

Wherein R, X, a, b and c are as defined hereinbefore. Examples of naphthaquinones useful in this invention include 1,4-diamino naphthaquinone, 1-amino-4-hydroxy naphthaquinone, 2-chloro-1,4-diamino naphthaquinone, 2-phenoxy-1,4-diamino naphthaquinone, 2-(4-methyl phenoxy)diamino naphthaquinone, 2-(4-hydroxy ethyl phenoxy)diamino naphthaquinone, 2-(4-dodecyl phenoxy)diamino naphthaquinone, 1-amino-4-mercapto naphthaquinone, 1,4-diamino-2,3-dichloro naphthaquinone and 1,5-diamino naphthaquinone. Preferred naphthaquinones include 1,4-diamino naphthaquinone, 1-amino-4-hydroxy naphthaquinone and 1-amino-4-mercapto naphthaquinone: with 4-diamino naphthaquinone being most preferred.

Metal salts useful for preparing the electrically conducting complexes of this invention include metal salts of Group VIII metals, Group IB metals and Group IIB metal salts. Preferred metal salts include salts of copper, silver, cobalt, nickel, gold, platinum or palladium. More preferred metal salts are salts of copper, nickel, silver or cobalt. Even more preferred metal salts are salts of copper, nickel or cobalt. Most preferred metal salts are copper (I) salts. Metal salts refer herein to any salt of the hereinbefore described metals which will react with the hereinbefore described anthraquinones or naphthaquinones under the conditions described herein. Preferred metals salts are the halides, nitrates and salts of organic carboxylic acids, for example, acetates and oxalates. More preferred salts include halides, acetates and nitrates. Even more preferred salts are the halides; with the chlorides being most preferred. Examples of some preferred salts include copper (I) chloride, copper (II) chloride or nickel chloride. The most preferred salt is copper (I) chloride.

In one preferred embodiment, the salts used to prepare the complexes are those salts wherein the metals are in the +1 or +2 oxidation state. In an even more preferred embodiment, the metal salt used is a salt in which the metal is in a +1 oxidation state.

In another preferred embodiment, metals which form square planar complexes are preferred metals.

In a preferred embodiment, the complex of this invention is the reaction product of (a) an anthraquinone or naphthaquinone; and (b) a Group VII, Group IB or Group IIB metal salt; and (c) oxygen.

The oxygen can be present as pure oxygen, or as an oxygen-containing gas such as air. Generally, a sufficient amount of oxygen to give an electrically conducting complex is used.

The novel composition of this invention is a coordination polymer comprised of anthraquinone or naphthaquinone and metal ion units. These electrical conducting coordination complex polymers are electrically conductive, infusible, insoluble and stable in air and in water. These complexes generally have a molecular weight (Mn) of between about 600 and 10,000, more preferably between about 1,000 and 3,000. Such polymers usually have a metal content of between about 6 and 50 weight percent, more preferably between about 20 and 30 weight percent. In one preferred embodiment, the polymer consists of alternating anthraquinone or naphthaquinone and dioxodimetal units. The polymers are generally intrinsic p-type semiconducters having conductivities of between about 0.001 and 30.0 S/cm. Note that in cases where the polymer is in a single crystal form, its conductivities are about 2 magnitudes higher than where it is in the powder form.

In a more preferred embodiment, the polymers of this invention generally correspond to the following formula

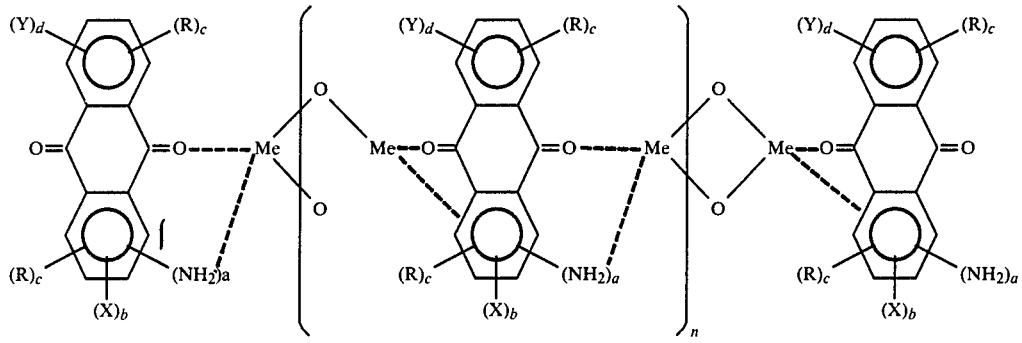

or

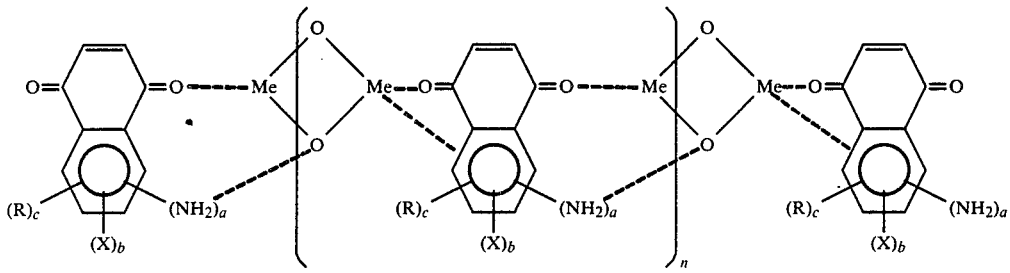

wherein R, X, Y, a, b, c and d are as hereinbefore defined and n is an integer of from 0 to 24, preferably 1 to 6.

In a most preferred embodiment, a 1,4-diamino anthraquinone is reacted with copper (I) chloride. This polymer consists of alternating 1,4-diamino anthraquinone and dioxodicopper units and is of a low molecular weight (Mn), between about 600 and 10,000, more preferably between about 1,000 and 3,000. The polymers derived from 1,4-diamino anthraquinone and copper (I) chloride preferably have an empirical formula of $C_{14}H_{10}N_2O_{3-4}Cu_{1-2}$. Such polymers correspond to the formula

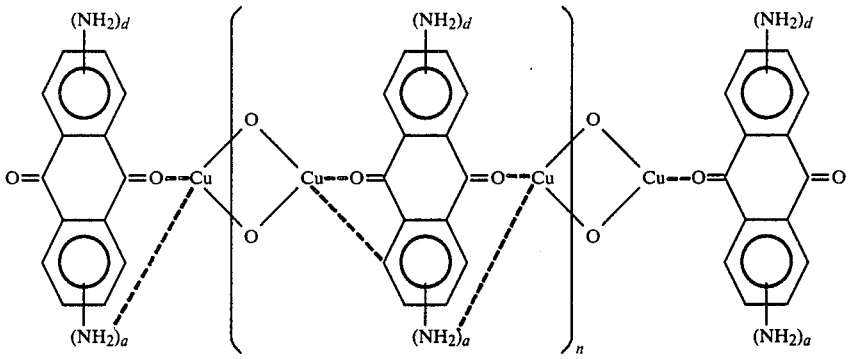

wherein a and d are as defined hereinbefore and n is between about 0 and 24, and most preferably between about 1 and 6.

The novel electrical conducting polymers of this invention are prepared by a process wherein an anthraquinone or naphthaquinone are reacted with a Group VIII metal, Group IB metal or Group IIB metal salt in a reaction medium. Preferably, the ratio of metal salt to anthraquinone or naphthaquinone is 1:1 or greater, more preferably 2:1 or greater, and most preferably between about 2:1 and 4:1. The conductivity of the complexes of this invention is optimum wherein such ratio is between about 2:1 and 4:1. The conductivity is lower as the ratio is increased or decreased.

It is preferable to contact the anthraquinone or naphthaquinone with the metal salt in the presence of an oxygen-containing gas. Suitable oxygen-containing gases include pure oxygen and air. That amount of oxygen which gives the desired product is suitable for this process.

It is preferable to run this process in the presence of a tertiary amine. The presence of the tertiary amine enhances the rates and yields of the process, especially when silver or nickel salts are used. That amount of tertiary amine which enhances the rate of reaction and gives the desired yield is suitable for this process. Generally, between about 0.1 and 1.0 mole of tertiary amine per mole of naphthaquinone or anthraquinone may be used. Examples of tertiary amines which can be used are triethylamine, tri-n-butylamine, triisopropylamine, tetramethylenediamine, N-methylpiperidine, N,N-dicyclohexylethylamine, benzyldiethylamine, dimethylisopropylamine and tri-n-propylamine. Triethylamine is the most preferred tertiary amine.

Reaction media refers herein to liquid media wherein the reaction of an anthraquinone or naphthaquinone with a metal salt takes place. Under preferred conditions, the reaction medium serves as a solvent for both the metal salt and the naphthaquinone or anthraquinone. Preferred reaction media are the polar aprotic solvents. Among preferred polar aprotic solvents are the nitriles, cyclic amines, amides, cyclic ethers and dimethylsulfoxide. More preferred solvents are pyridine, dimethylformamide, acetonitrile, tetrahydrofuran and dimethylsulfoxide. The most preferred solvent is pyridine. Under preferred conditions, the amount of the reaction medium which dissolves both the metal salt and the anthraquinone or naphthaquinone is used in this process.

This process may be run at any temperature at which an electrically conducting complex is prepared. Preferably, such temperature is between the freezing point of the reaction medium and that highest temperature at which the complex prepared is electrically conducting. Preferred temperatures are between about −30° C. and 90° C. Most preferred temperatures are between about −30° C. and 25° C. Above about 90° C. the electrical conductivity of the complex prepared begins to drop off significantly.

The process may be performed for a sufficient amount of time to give the desired yields of the desired product. Preferable times are between about 1 and 18 hours, with between about 4 and 6 hours being most preferred.

The electrically conducting complexes of this invention generally precipitate out of the reaction medium. Such complexes may be recovered by filtration and thereafter washed to purify as described hereinafter.

It is preferred to run the process of this invention under anhydrous conditions, as the presence of water may result in the formation of unwanted by-products, such as metal hydroxides.

The complexes of this invention may be purified by first washing the recovered precipitate with any solvent in which the anthraquinone or naphthaquinone is soluble. Preferred solvents are amides, aromatic chlorinated hydrocarbons and ketones. The most preferred solvent is acetone. The recovered precipitate is washed with a sufficient amount of acetone to remove the unreacted quinones. Thereafter the recovered precipitate is washed with water to remove all unreacted metal salts. That amount of water which removes the unreacted metal salts is sufficient. Thereafter, the recovered precipitate is washed with a chlorinated aliphatic hydrocarbon, such as methyl chloride, so as to ensure all of the unreacted components are removed.

SPECIFIC EMBODIMENTS

The following examples are included for illustrative purposes only, the examples do not limit the scope of the invention or the claims. All parts and percentages are by weight unless otherwise described.

EXAMPLE 1

2-Chloro-1,4-diamino anthraquinone

A mixture of thionyl chloride (320 g) and 1,4-diamino anthraquinone (20 g) is refluxed for 24 hours. The mixture is then cooled and poured onto crushed ice. The precipitate is filtered, dried and purified by recrystallization from carbon tetrachloride. The yield is 50 percent 2-chloro-1,4-diamino anthraquinone with a melting point of 207° C. to 210° C.

EXAMPLE 2

2-(p-Hydroxy ethyl phenoxy)-1,4-diamino anthraquinone

A solution of dimethylsulfoxide (50 ml), water (5.0 ml), 2-chloro-1,4-diamino anthraquinone (5.0 g) and sodium hydroxide (1.0 g) is heated to 100° C. for 4 hours. The mixture is cooled and diluted with water until a precipitate forms. The precipitate is collected, washed, dried and recrystallized from carbon tetrachloride. The yield is 24 percent 2-(p-hydroxy ethyl phenoxy)-1,4-diamino anthraquinone with a melting point of 224° C. to 227° C.

EXAMPLE 3

Poly($\mu_2$-dioxodicopper-1,4-diamino anthraquinone

White copper (I) chloride (20.0 g) is dissolved in deoxygenated pyridine (1.0 liter). The 1,4-diamino anthraquinone (23.8 g), recrystallized from acetone with a melting point of 265° C., is added and oxygen bubbled through the mixture for 18 hours. The mixture is then filtered and the filtrate washed successively with acetone, water, acetone and finally methylene chloride to remove unreacted starting materials and copper (II) chloride. The yield is 19.6 g of a dark blue-black powder having a conductivity of 0.1–0.3 S/cm.

EXAMPLE 4

Copper (II)-1,4-diamino anthraquinone

Copper (II) chloride dihydrate (0.71 g) is dissolved in dimethylformamide (30 ml) and 1,4-diamino anthraquinone (1.0 g) is added. The mixture quickly turns into a paste and is filtered and washed with methylene chloride before drying. The filtrate is then washed with water, acetone and finally methylene chloride and dried overnight in a vacuum oven. The yield is 0.86 g of a dark blue powder having a conductivity of $1.32\times10^{-2}$ S/cm. Analysis shows a composition of C—56.84 percent, H—3.86 percent, N—9.10 percent, Cu—5.7 percent and Cl—7.7 percent.

EXAMPLE 5

Nickel (II)-1,4-diamino anthraquinone

Nickel (II) chloride hexahydrate (0.5 g) is dissolved in dimethylformamide (25 ml) containing 1,4-diamino anthraquinone (0.5 g) and triethylamine (0.84 g). A precipitate forms and is collected and washed repeatedly with methylene chloride until the washings are colorless. The yield is 0.66 g of a dark blue-black powder having a conductivity of $4.72\times10^{-3}$ S/cm. Analysis shows a composition of C—59.34 percent, H—3.76 percent, N—9.38 percent, Ni—17.2 percent and Cl—2.6 percent.

EXAMPLE 6

Silver-1,4-diamino anthraquinone

Silver (I) nitrate (0.71g) is dissolved in acetonitrile (25 ml). Triethylamine (0.3 ml) and 1,4-diamino anthraquinone (0.5 g) are added and a precipitate forms immediately. The precipitate is collected and washed with acetonitrile, dimethylformamide, acetonitrile, and finally methylene chloride before drying. The yield is 0.22 g of a dark blue-black powder having a conductivity of $7.9\times10^{-3}$ S/cm. Analysis shows a composition of C—38.6 percent, H—2.06 percent, N—6.12 percent and Ag—40.1 percent.

The Glass Cell Resistance Test—Procedure

A glass plate coated with a thin transparent layer of conducting tin oxide, 2 inches by 2 inches, is scratched down the middle creating an insulating gap, approximately 1 mm, between the two conducting areas. The sample is placed on the gap and a plate of 1 inch by 1 inch non-conducting glass is clamped over it with bulldog clamps to provide good contact. The resistance, R, is measured across the cell, but because the dimensions through which the current passes is not known, a conductivity cannot be calculated. The R obtained is reproducible provided the sample size and clamping pressure remain constant. The conductivity can be estimated from the glass cell by use of a plot log of R versus log $\sigma$ for samples of known conductivity.

EXAMPLE 7

Effect of reaction temperature on resistance

Cuprous chloride (1.0 g) is dissolved in a mixture of pyridine and dimethylacetamide (20/80, 50 ml). 1,4-Diamino anthraquinone (2.4 g) is added and oxygen is bubbled through the solution for 6 hours. Three runs at different temperatures are performed. The results are compiled in Table I. The resistance of each sample is measured using the glass cell resistance test.

TABLE I

| Temperature (°C.) | Resistance (ohms) |
|---|---|
| 90 | $>2\times10^{7}$ |
| 25 | $0.4\text{–}1.5\times10^{3}$ |
| −30 | $2.1\times10^{3}$ |

EXAMPLE 8

A series of complexes are prepared from cuprous chloride and 1,4-diamino anthraquinone wherein the reactant ratio is varied. The resistance of each of the complexes is measured using the glass cell resistance test. The results are compiled in Table II.

TABLE II

| Copper (I)/1,4-diamino anthraquinone (moles) | Resistance (ohms) |
|---|---|
| 0.5 | $8\times10^{4}$ |
| 1.0 | $8\times10^{3}$ |
| 2.0 | $3\times10^{3}$ |
| 4.0 | $60\times10^{4}$ |

EXAMPLE 9

The conductivities of complexes of 1,4-diamino anthraquinones with different metal salts are determined using the brass cell test. In this study the brass cell is completely tightened in a bench vice to 1800 psi and the resistance is measured. The pressure is determined with a load cell placed in series with the brass cell. The sample area is 2.85 $cm^2$, and the length is 0.1 to 0.3 cm. The conductivity is calculated from the resistance by the equation $$\sigma=l/RA$$

where $\sigma$ is conductivity in Siemens per cm, R is resistance in ohms, l is length cm, and area $cm^2$. The results are compiled in Table III.

TABLE III

| Metal ion | Conductivity (Siemens/cm) |
|---|---|
| Copper I | $1\text{–}3\times10^{-1}$ |
| Copper II | $1.32\times10^{-2}$ |
| Nickel II | $4.72\times10^{-3}$ |
| Silver I | $7.9\times10^{-3}$ |

What is claimed is:

1. A complex comprising the reaction product of
(a) an anthraquinone, naphthaquinone, or both; and
(b) a metal ion;
wherein the complex has a conductivity of between about 0.0001 and 30 S/cm.

2. The complex of claim 1 which is the reaction product of
(a) an anthraquinone or naphthaquinone;
(b) a metal salt; and
(c) oxygen.

3. The complex of claim 2 which comprises a polymeric structure of alternating units of
(a) an anthraquinone or a naphthaquinone; and
(b) $\mu_2$ dioxo-dimetal units.

4. The complex of claim 2 wherein the mole ratio of the metal salt to the anthraquinone or the naphthaquinone is 1:1 or greater.

5. The complex of claim 4 wherein the mole ratio of metal salt to the anthraquinone or the naphthaquinone is between about 2:1 and 4:1.

6. The complex of claim 4 wherein the anthraquinones correspond to the formula

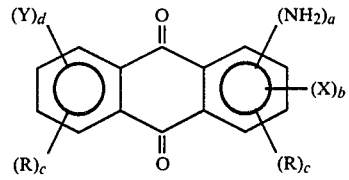

and the naphthaquinone corresponds to the formula

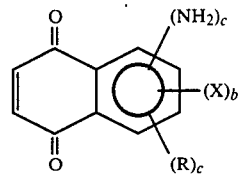

wherein

R is separately in each occurrence halo, aryloxy, alkoxy, aralkoxy, alkaryloxy, alkyl, aryl, aralkyl, alkaryl, nitro or cyano, wherein the alkyl, alkaryl, aryl, aralkyl, alkoxy, aryloxy, alkaryloxy or aralkoxy groups are unsubstituted or substituted with one or more substituents comprising halo, hydroxy, amino, cyano or nitro groups;

X is separately in each occurrence hydroxy or mercapto groups;

Y is separately in each occurrence a primary amino, hydroxy or mercapto group;

a is separately in each occurrence an integer of from 1 to 4, inclusive;

b is separately in each occurrence an integer of from 0 to 3, inclusive;

c is separately in each occurrence an integer of from 0 to 3, inclusive; and d is separately in each occurrence an integer of from 0 to 4, inclusive;

with the proviso that the sum of a, b and d must be 2 or greater; and with the further proviso that non-adjacent carbon atoms are substituted with two $NH_2$ moieties, or with one $NH_2$ moiety and either an OH or SH moiety.

7. The complex of claim 6 wherein

R is halo, $C_{1-20}$ aryloxy, $C_{1-20}$ alkoxy, $C_{1-20}$ aralkoxy or $C_{1-20}$ alkaryloxy, wherein the aryloxy, alkoxy, alkaryloxy or aralkoxy groups are unsubstituted or substituted with a halo or hydroxy group;

a is separately in each occurrence 1 or 2;

b is separately in each occurrence 0 or 1;

c is separately in each occurrence 0 or 1; and d is separately in each occurrence 0 or 1.

8. The complex of claim 7 wherein

R is separately in each occurrence halo, phenoxy, (2-hydroxyethyl)phenoxy or $C_{1-10}$ alkoxy;

X is OH; and

Y is separately in each occurrence OH or $NH_2$.

9. The complex of claim 8 wherein Y is $NH_2$; b is 0; and c is 0.

10. The complex of claim 7 wherein the metal salt is a salt of copper, silver, cobalt, gold, nickel, platinum or palladium.

11. The complex of claim 10 wherein the metal salt is a salt of copper, nickel, silver or cobalt.

12. The complex of claim 11 wherein the metal salt is a salt of copper, nickel or cobalt.

13. The complex of claim 12 wherein the metal salt is a copper (I) salt.

14. The complex of claim 6 which corresponds to one of the formulas

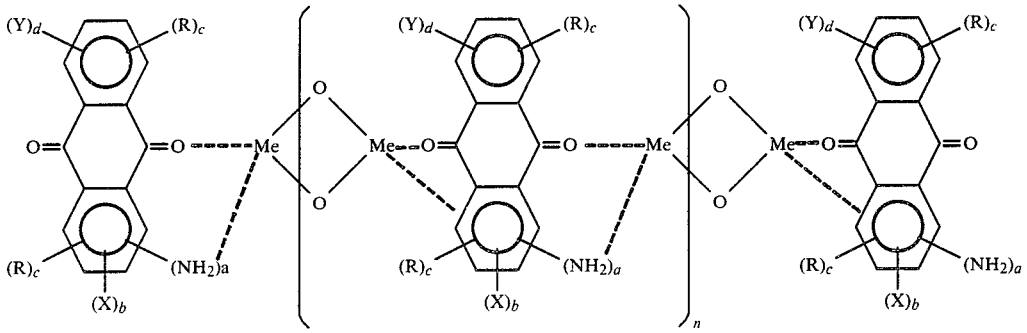

or

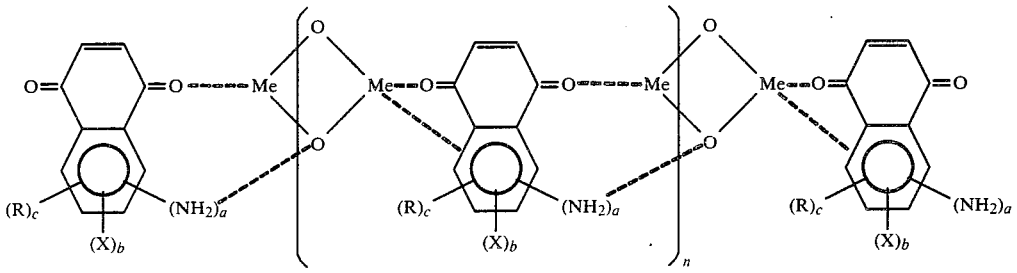

wherein

R is separately in each occurrence halo, aryloxy, alkoxy, aralkoxy, alkaryloxy, alkyl, aryl, aralkyl, alkaryl, nitro or cyano, wherein the alkyl, alkaryl, aryl, aralkyl, alkoxy, aryloxy, alkaryloxy or aralkoxy groups are unsubstituted or substituted with one or more substituents comprising halo, hydroxy, amino, cyano or nitro groups;

X is separately in each occurrence hydroxy or mercapto groups;

Y is separately in each occurrence a primary amino, hydroxy or mercapto group;

a is separately in each occurrence an integer of from 1 to 4, inclusive;

b is separately in each occurrence an integer of from 0 to 3, inclusive;

c is separately in each occurrence an integer of from 0 to 3, inclusive;

d is separately in each occurrence an integer of from 0 to 4, inclusive; and n is a real number of from about 0 to about 24.

15. The complex of claim 14 which corresponds to the formula

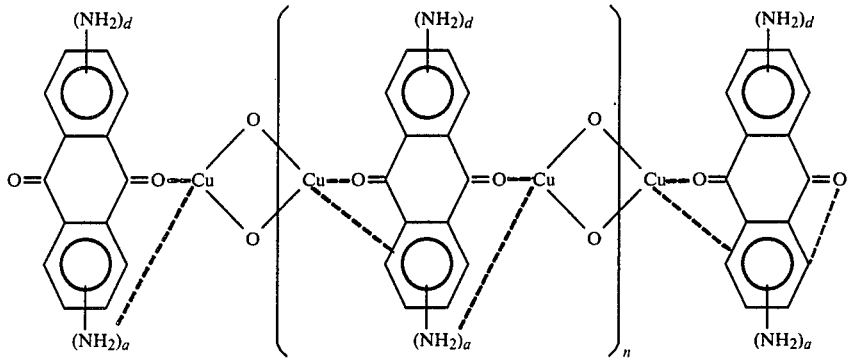

wherein a is separately in each occurrence an integer of from about 1 to about 4; d is separately in each occurrence an integer of from about 0 to about 4; and n is a real number of from about 0 to about 10.

16. A process for the preparation of electrically conducting complexes which comprises contacting (a) an anthraquinone or naphthaquinone substituted with at least one amino group and further substituted with at least one amino, hydroxy or mercapto group, wherein one amino group and one amino, hydroxy or mercapto group are on nonadjacent carbon atoms; with (b) a Group VIII, Group IB or Group IIB salt;

in a polar aprotic reaction medium, in the presence of an oxygen-containing gas under conditions such that an electric conducting complex is prepared.

17. The process of claim 1 wherein the ratio of metal salts to anthraquinone or naphthaquinone is 1:1 or greater.

18. The process of claim 17 wherein the ratio of metal salt to anthraquinone or naphthaquinone is between about 2:1 and 4:1.

19. The process of claim 18 wherein

R is halo, $C_{1-20}$ aryloxy, $C_{1-20}$ alkoxy, $C_{1-20}$ aralkoxy or $C_{1-20}$ alkaryloxy, wherein the aryloxy, alkoxy, alkaryloxy or aralkoxy groups are unsubstituted or substituted with a halo or hydroxy group;

a is separately in each occurrence 1 or 2;

b is separately in each occurrence 0 or 1;

c is separately in each occurrence 0 or 1; and d is separately in each occurrence 0 or 1.

20. The process of claim 19 wherein R is separately in each occurrence halo, phenoxy, 2-(hydroxyethyl)-phenoxy or $C_{1-10}$ alkoxy; X is OH; and Y is separately in each occurrence OH or $NH_2$:

21. The process of claim 20 wherein Y is $NH_2$; b is 0; c is 0; and d is 0 or 1.

22. The process of claim 21 wherein the metal salt is a salt of copper, silver, cobalt, gold, nickel, platinum or palladium.

23. The process of claim 22 wherein the metal salt is a salt of copper, nickel, silver or cobalt.

24. The process of claim 23 wherein the metal salt is a salt of copper, nickel or silver.

25. The process of claim 23 wherein the metal salt is a copper (I) salt.

26. The process of claim 25 wherein the temperature is between about −30° C. and 90° C.

27. The process of claim 26 wherein the solvent is a chlorinated aromatic hydrocarbon, a nitrile, a cyclic amine, a cyclic amide, a cyclic ether or a dialkylsulfoxide.

28. The process of claim 27 wherein the solvent is dimethylformamide, tetrahydrofuran or pyridine.

29. The process of claim 28 wherein the reaction time is between about 1 and 18 hours.

30. An electrically conducting complex prepared by the process which comprises contacting (a) an anthraquinone or naphthaquinone substituted with at least one amino group and further substituted with at least one amino, hydroxy or mercapto group, wherein one amino group and one amino, hydroxy or mercapto group are on nonadjacent carbon atoms; with (b) a Group VIII, Group IB or Group IIB salt;

in a polar aprotic reaction medium, in the presence of an oxygen-containing gas under conditions such that an electric conducting complex is prepared.

31. The complex of claim 30 wherein the contacting takes place in the presence of a tertiary amine.

32. The complex of claim 31 wherein the ratio of the metal salts to the anthraquinone or the naphthaquinone is 1:1 or greater.

33. The comlex of claim 32 wherein the ratio of the metal salt to the anthraquinone or the naphthaquinone is between about 2:1 and 4:1.

34. The complex of claim 33 wherein the anthraquinone corresponds to the formula

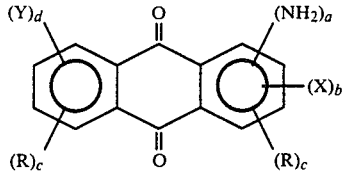

and the naphthaquinone corresponds to the formula

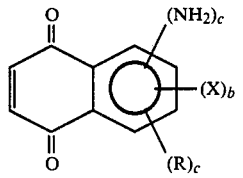

wherein

R is separately in each occurrence halo, aryloxy, alkoxy, aralkoxy, alkaryloxy, alkyl, aryl, aralkyl, alkaryl, nitro or cyano, wherein the alkyl, alkaryl, aryl, aralkyl, alkoxy, aryloxy, alkaryloxy or aralkoxy groups are unsubstituted or substituted with one or more substituents comprising halo, hydroxy, amino, cyano or nitro groups;

X is separately in each occurrence hydroxy or mercapto groups;

Y is separately in each occurrence a primary amino, hydroxy or mercapto group;

a is separately in each occurrence an integer of from 1 to 4, inclusive;

b is separately in each occurrence an integer of from 0 to 3, inclusive;

c is separately in each occurrence an integer of from 0 to 3, inclusive; and d is separately in each occurrence an integer of from 0 to 4, inclusive;

with the proviso that the sum of a, b and d must be 2 or greater; and with the further proviso that non-adjacent carbon atoms are substituted with two $NH_2$ moieties, or with one $NH_2$ moiety and either an OH or SH moiety.

35. The complex of claim 34 wherein

R is halo, $C_{1-20}$ aryloxy, $C_{1-20}$ alkoxy, $C_{1-20}$ aralkoxy or $C_{1-20}$ alkaryloxy, wherein the aryloxy, alkoxy, alkaryloxy or aralkoxy groups are unsubstituted or substituted with a halo or hydroxy group;

a is separately in each occurrence 1 or 2;

b is separately in each occurrence 0 or 1;

c is separately in each occurrence 0 or 1; and d is separately in each occurrence 0 or 1.

36. The complex of claim 35 wherein

R is separately in each occurrence halo, phenoxy, 2-(hydroxyethyl)phenoxy or $C_{1-10}$ alkoxy;

X is OH; and

Y is separately in each occurrence OH or $NH_2$.

37. The complex of claim 36 wherein Y is $NH_2$; b is 0; c is 0; and d is 0 or 1.

38. The complex of claim 37 wherein the metal salt is a salt of copper, silver, cobalt, gold, nickel, platinum or palladium.

39. The complex of claim 38 wherein the metal salt is a copper (I) salt.

40. The complex of claim 39 wherein the temperature is between about −30° C. and 90° C.

41. The complex of claim 40 wherein the solvent is a chlorinated aromatic hydrocarbon, a nitrile, a cyclic amine, a cyclic amide, a cyclic ether or a dialkylsulfoxide.

42. The complex of claim 41 wherein the solvent is dimethylformamide, tetrahydrofuran or pyridine.

43. The complex of claim 42 wherein the reaction time is between about 1 and 18 hours.

44. The complex of claim 33 which comprises a polymeric structure of alternating units of (a) anthraquinone or naphthaquinone; and (b) $\mu_2$ dioxo-dimetal units.

45. The complex of claim 1 wherein the metal ion forms a square planar complex.

46. The complex of claim 45 wherein the metal ion is in a +1 or +2 oxidation state.

47. The complex of claim 45 wherein the metal ion is an ion of Group VIII, Group IB or Group IIB metals.

48. The complex of claim 1 wherein any anthraquinone or naphthaquinone contain at least 2 substituents selected from the class consisting of primary amine group, hydroxy group and mercapto group; providing that at least one substituent is a primary amine group which is bonded to a carbon atom nonadjacent to a carbon atom bonded to one of the specified substituents.

* * * * *